US008076563B2

(12) United States Patent
Kamimura

(10) Patent No.: US 8,076,563 B2
(45) Date of Patent: Dec. 13, 2011

(54) KEYBOARD DEVICE

(75) Inventor: Norizo Kamimura, Tokorozawa (JP)

(73) Assignee: Casio Computer Co., Ltd, Tokyo (JP)

( * ) Notice: Subject to any disclaimer, the term of this patent is extended or adjusted under 35 U.S.C. 154(b) by 0 days.

(21) Appl. No.: 12/822,547

(22) Filed: Jun. 24, 2010

(65) Prior Publication Data

US 2011/0005369 A1 Jan. 13, 2011

(30) Foreign Application Priority Data

Jul. 10, 2009 (JP) ..... 2009-163526

(51) Int. Cl.
*G10C 3/12* (2006.01)

(52) U.S. Cl. ..... 84/423 R

(58) Field of Classification Search ..... 84/423 R, 84/7, 20, 21, 25–29, 33, 34, 174, 236–238
See application file for complete search history.

(56) References Cited

U.S. PATENT DOCUMENTS 5,571,982 A * 11/1996 Masubuchi ..... 84/658
6,147,290 A 11/2000 Uno

FOREIGN PATENT DOCUMENTS

| | | |
|---|---|---|
| JP | 06025884 | 4/1994 |
| JP | 11305759 | 11/1999 |
| JP | 2002108341 | 4/2002 |
| JP | 2004226687 | 8/2004 |
| JP | 2005241887 | 9/2005 |
| JP | 2009086425 | 4/2009 |

* cited by examiner

*Primary Examiner* — Kimberly Lockett
(74) *Attorney, Agent, or Firm* — Turocy & Watson, LLP

(57) ABSTRACT

A keyboard device configured such that, when L represents a distance in a horizontal direction from a rotation support of a hammer member 3 to a contact point where a key 2 comes into contact with an elastic section 23 of the hammer member 3, I represents a moment of inertia around the rotation support, and K represents an elastic modulus in a vertical direction of the elastic section 23 coming into contact with the key 2, the relationship of L, I and K is set to $(2/\pi)2\cdot K\cdot 10-4 \leqq (I/L2) \leqq 4\cdot (2/\pi)2\cdot K\cdot 10-4$. Accordingly, when the key 2 is depressed, a timing at which an action load applied to the key 2 by the hammer member 3 reaches its maximum is delayed by 10-20 milliseconds from the start of the depression, whereby the maximum action load can be applied at a timing that gives a key-touch feel close to that of an acoustic piano.

6 Claims, 8 Drawing Sheets

KEYBOARD DEVICE

CROSS-REFERENCE TO RELATED APPLICATION

This application is based upon and claims the benefit of priority from the prior Japanese Patent Application No. 2009-163526, filed Jul. 10, 2009, the entire contents of which is incorporated herein by reference.

BACKGROUND OF THE INVENTION

1. Field of the Invention

The present invention relates to a keyboard device used in a keyboard instrument, such as an electronic piano. In particular, the present invention relates to a keyboard device that applies an action load in response to the depression of a key.

2. Description of the Related Art

As described in Japanese Patent Application Laid-Open (Kokai) Publication No. 2004-226687, a keyboard instrument is conventionally known that is configured to achieve a key-press feel similar to that of an acoustic piano. In this keyboard instrument, keys are provided on a keyboard chassis in a manner to be rotatable in a vertical direction, and hammer members are provided in the keyboard chassis in a manner to be rotatable in the vertical direction. When a key is depressed, the hammer member rotates to be displaced in response to this key depression operation, thereby applying an action load to the key.

In a keyboard instrument such as that described above, a hammer holding section is provided in a key to ensure that pressing force applied when the key is depressed is transmitted to a hammer member. This hammer holding section slidably holds the tip end portion of the hammer member, and connects the key and the hammer member. As a result, when the key is depressed, the pressing force on the key is quickly transmitted to the hammer member.

However, in a conventional keyboard instrument such as this, because the tip end portion of a hammer member is slidably held by a hammer holding section provided in a key, pressing force on the key is quickly transmitted to the hammer member upon the depression of the key, and in response thereto, reaction force that is an action load is quickly transmitted to the key by the hammer member. Accordingly, a key-press feel similar to that of an acoustic piano, where the timing at which an action load applied to a key upon the depression thereof reaches its maximum is temporally delayed, cannot be achieved. Therefore, there is a problem in that the key-press feel differs from that of an acoustic piano.

SUMMARY OF THE INVENTION

The present invention has been conceived to solve the above-described problem. An object of the present invention is to provide a keyboard device capable of achieving a key-press feel more similar to the key-press feel of an acoustic piano.

In order to achieve the above-described object, in accordance with one aspect of the present invention, there is provided a keyboard device comprising: a keyboard chassis; a key provided on the keyboard chassis in a manner to be rotatable in a vertical direction; a hammer member for applying an action load to the key by rotating to be displaced in response to depression of the key; and an elastic section provided in at least one of either the hammer member or the key, which is elastically deformed in response to the depression of the key; wherein the keyboard device is configured such that, when considered as a mechanical oscillation system model where L represents a distance in a horizontal direction from a rotation support of the hammer member to a contact point at which the key comes into contact with the hammer member, I represents a moment of inertia around the rotation support of the hammer member, and K represents an elastic modulus in a vertical direction of the elastic section in at least one of either the hammer member or the key, in an initial state in which the key has not been depressed, a relationship of the distance L in the horizontal direction, the moment of inertia I, and the elastic modulus K is set to $(2/\pi)^2 \cdot K \cdot 10^{-4} \leqq (I/L^2) \leqq 4 \cdot (2/\pi)^2 \cdot K \cdot 10^{-4}$, and a timing at which the action load applied to the key by the hammer member in response to the depression of the key reaches a maximum is delayed by a predetermined amount of time.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

The present invention will hereinafter be described in detail with reference to the embodiments shown in FIG. 1 to FIG. 8, where the present invention has been applied to a keyboard device.

Figure 1:
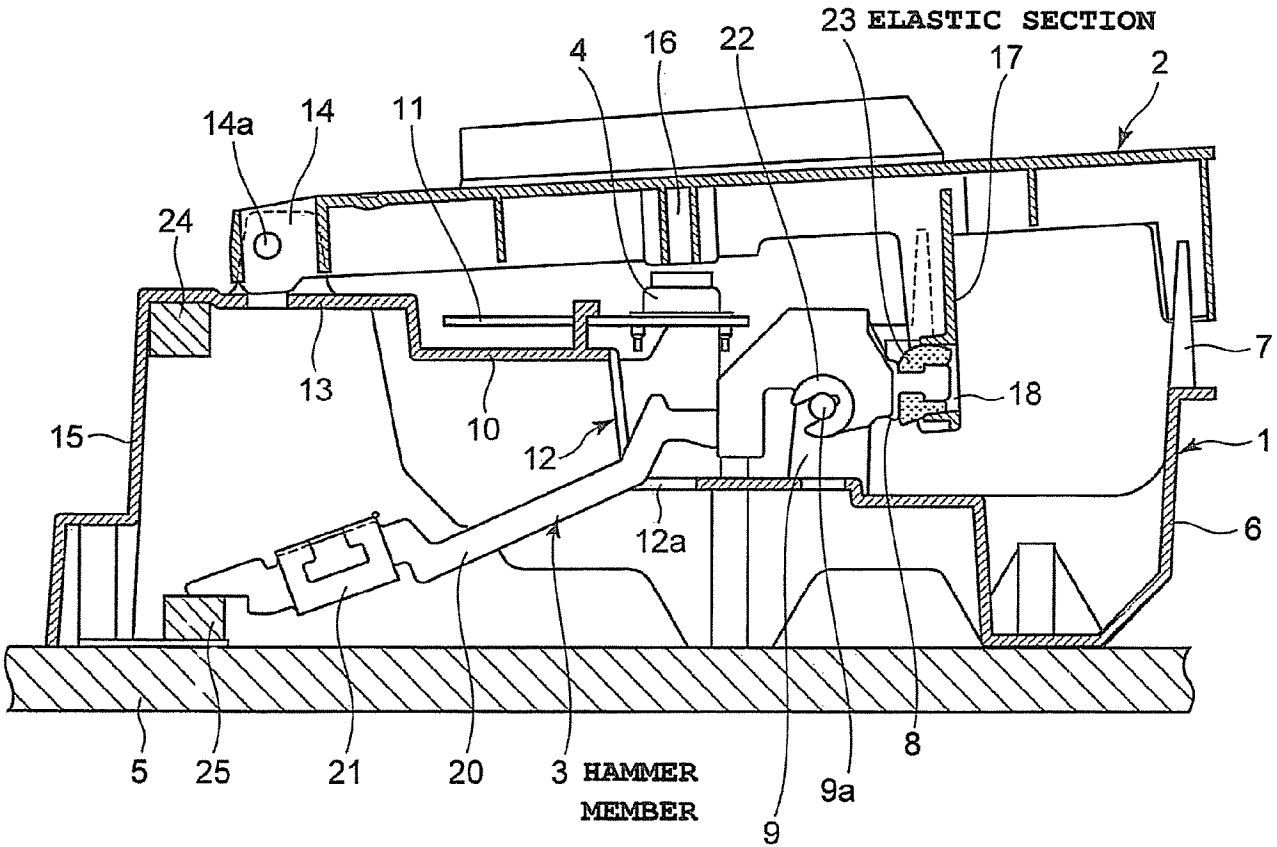
FIG. 1 is a cross-sectional view showing the key sections of an embodiment where the present invention has been applied to a keyboard device.

As shown in FIG. 1, the keyboard device includes a keyboard chassis 1 made of synthetic resin, a plurality of keys 2 (white keys and black keys, although only a single white key will be described herein), hammer members 3, and rubber switches 4. The plurality of keys 2 are arranged on the keyboard chassis 1 in a manner to be rotatable in a vertical direction, and the hammer members 3 respectively apply action load to this plurality of keys 2. The rubber switches 4 respectively output an ON signal in response to the depression of a key 2.

As shown in FIG. 1, the keyboard chassis 1 is arranged on a lower-portion case 5 of an instrument body, and a front leg section 6 is formed in the front end portion (right end portion in FIG. 1) of this keyboard chassis 1 so as to project upwards from the bottom portion. In addition, a key guiding section 7, which is inserted into the front side of the key 2 to prevent horizontal play of the key 2, is provided in the front end portion (right end portion in FIG. 1) of the front leg section 6, and a hammer placing section 8 is formed on the rear portion side (left side portion in FIG. 1) of the front leg section 6, at a height lower than that of the front leg section 6.

Also, as shown in FIG. 1, a hammer supporting section 9 for supporting the hammer member 3 is provided in the upper portion of the hammer placing section 8 so as to project upward, and a supporting shaft 9*a* serving as a rotation support for rotatably supporting the hammer member 3 is provided in this hammer supporting section 9. In addition, as shown in FIG. 1, a board placing section 10 is formed in the center portion of the keyboard chassis 1, that is, on the rear portion side (left side in FIG. 1) of the hammer placing section 8, at a height higher than that of the hammer placing section 8 and slightly higher than that of the front leg section 6.

Moreover, as shown in FIG. 1, a switch board 11 for mounting the rubber switch 4 is attached to the upper surface of the board placing section 10. In this instance, a rising section 12 is formed between the board placing section 10 and the hammer placing section 8, and a hammer-insertion opening 12*a* is formed in this rising section 12. The front portion side (end portion on the right side in FIG. 1) of the hammer member 3, described hereafter, is inserted into the opening 12*a*, and the opening 12*a* places the hammer member 3 above the hammer placing section 8.

Furthermore, as shown in FIG. 1, a key placing section 13 is formed in the rear portion of the keyboard chassis 1, that is, the rear portion side of the board placing section 10 (left side in FIG. 1), at a height slightly higher than that of the board placing section 10, and a key supporting section 14 that supports the rear end portion of the key 2 is formed on the upper surface of this key placing section 13. The key supporting section 14 includes a supporting shaft 14*a* that supports the rear end portion of the key 2 in a manner to be rotatable in the vertical direction, and as shown in FIG. 1, a rear leg section 15 that supports the rear end portion of the keyboard chassis 1 on the lower-portion case 5 hangs downward from the rear end portion of the key placing section 13 of the keyboard chassis 1.

On the other hand, as shown in FIG. 1, the rear end portion (left end portion in FIG. 1) of the key 2 is supported in a manner to be rotatable in the vertical direction by the supporting shaft 14*a* of the key supporting section 14 provided on top of the key placing section 13 of the keyboard chassis 1, and a switch pressing section 16, which presses the rubber switch 4 of the switch board 11 mounted on the board placing section 10 of the keyboard chassis 1, is formed projecting downward in the center portion of this key 2.

In this instance, as shown in FIG. 1, the rubber switch 4, which includes a rubber sheet arranged on the switch board 11, is configured such that a dome-shaped protruding portion is formed in the rubber sheet so as to face the switch pressing section 16 of the key 2. As a result, in the configuration of the rubber switch 4, when the protruding portion of the rubber sheet is pressed by the switch pressing section 16, the protruding portion is elastically deformed, and a movable contact inside the protruding portion comes into contact with a fixed contact on the switch board 11, whereby the rubber switch 4 outputs an ON signal.

As shown in FIG. 1, a hammer holding section 17 that projects toward the bottom side of the key 2 is formed in an area in front (right side in FIG. 1) of the switch pressing section 16, and a rectangular opening 18 elongated in the vertical direction, into which an elastic section 23 provided in the front end portion of the hammer member 3 (right end portion in FIG. 1) described hereafter is inserted, is provided in the lower portion of this hammer holding section 17. This opening 18 is formed so as to slidably hold the elastic section 23 of the hammer member 3 and push the elastic section 23 downward in response to the depression of the key 2.

On the other hand, as shown in FIG. 1, the hammer member 3 includes a hammer body 20, an anchor section 21, a rotation supporting section 22 made of synthetic resin, and the elastic section 23. The anchor section 21 is provided in the rear portion (left side portion in FIG. 1) of the hammer body 20, and the rotation supporting section 22 is provided in the lower front portion (lower right portion in FIG. 1) of the hammer body 20. This rotation supporting section 22 is used to attach the hammer body 20 to the supporting shaft 9*a* serving as a rotation support provided in the hammer supporting section 9 of the keyboard chassis 1. The elastic section 23 is provided in the front end portion (right end portion in FIG. 1) of the hammer body 20 and elastically deformed when a key-depressing operation is performed.

In the configuration of the hammer member 3, as shown in FIG. 1, the elastic section 23 of the hammer body 20 is inserted into the opening 12*a* in the rising section 12 from the lower side of the keyboard chassis 1 and placed on the upper side of the hammer placing section 8. In this state, the rotation supporting section 22 of the hammer body 20 is rotatably attached to the supporting shaft 9*a* of the hammer supporting section 9 provided on the hammer placing section 8. As a result, the hammer body 20 rotates in the vertical direction around the supporting shaft 9*a* serving as the rotation support in the hammer supporting section 9.

Figure 2:
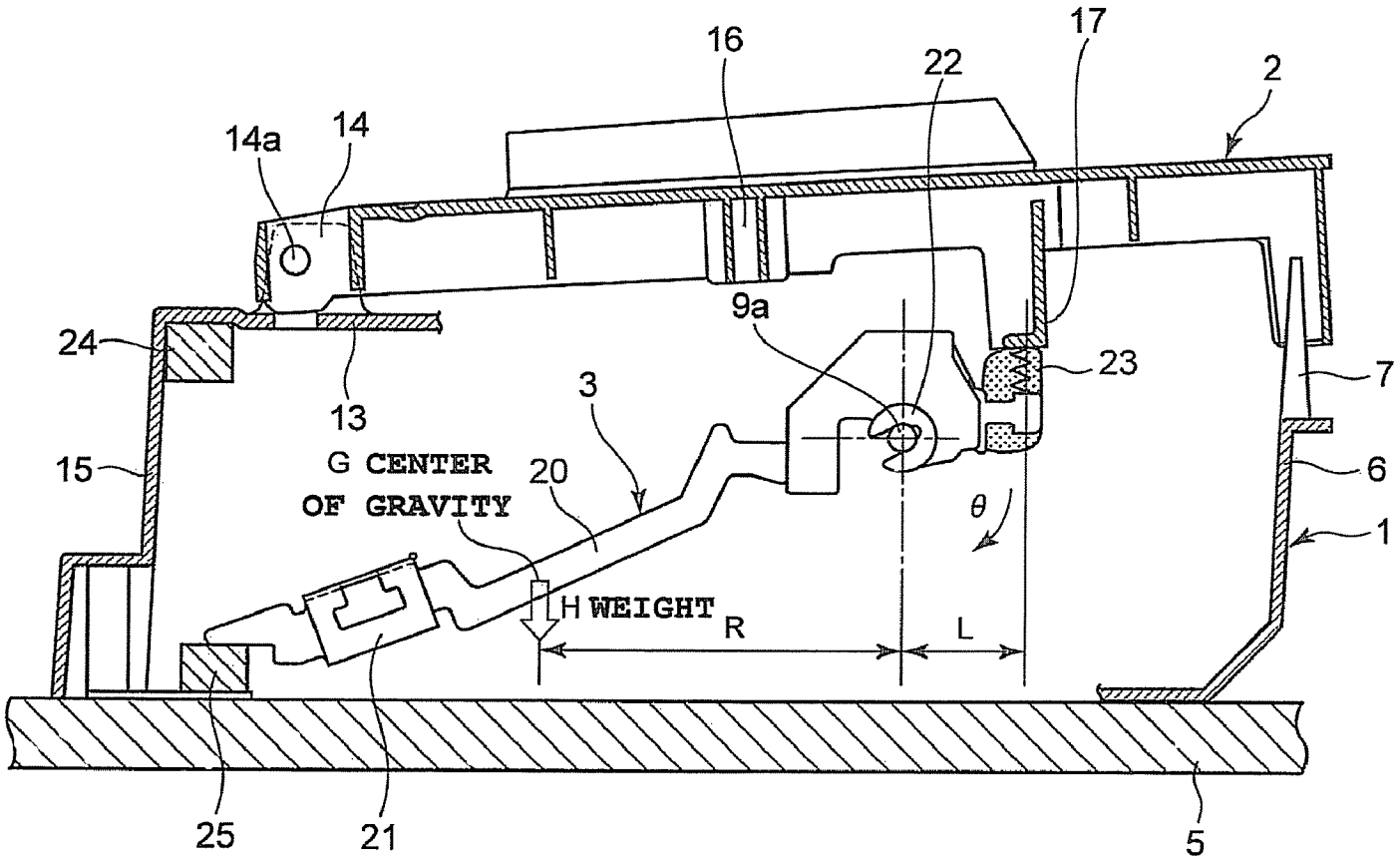
FIG. 2 is a diagram showing the parameter of each key section in the keyboard device in FIG. 1 when a hammer member rotates.

As shown in FIG. 1 and FIG. 2, the hammer member 3 is configured such that, when the rotation supporting section 22 of the hammer body 20 is rotatably attached to the supporting shaft 9*a* of the hammer supporting section 9, the elastic section 23 provided in the front end portion of the hammer body 20 is slidably inserted into the opening 18 formed in the hammer holding section 17 of the key 2.

Consequently, as shown in FIG. 1 and FIG. 2, the hammer member 3 is configured such that, when the key 2 is depressed from above, because the gravity center of the hammer body 20 including the weight of the anchor section 21 is at a distance from the supporting shaft 9*a* of the hammer supporting section 9 that is the rotational center of the rotation supporting section 22, the elastic section 23 of the hammer body 20 is pushed downward against the weight of the gravity center of the hammer body 20. With this movement, the hammer body 20 rotates in the clockwise direction around the supporting shaft 9*a* of the hammer supporting section 9, and the rear portion of the hammer body 20 comes into contact with an upper-limit stopper 24 such as felt provided on the lower surface of the key placing section 13 of the keyboard chassis 1.

In the configuration of the hammer member 3, as shown in FIG. 1 and FIG. 2, when the key 2 is not depressed, because the gravity center of the hammer body 20 including the weight of the anchor section 21 is at a distance from the supporting shaft 9*a* of the hammer supporting section 9 that is the rotational center of the rotation supporting section 22, the hammer body 20 rotates by the weight of the gravity center of the hammer body 20 in the counter-clockwise direction around the supporting shaft 9*a* of the hammer supporting section 9, whereby the rear portion of the hammer body 20 comes into contact with a lower-limit stopper 25 such as felt provided on the lower rear portion of the keyboard chassis 1. In this state, the elastic section 23 presses the hammer holding section 17 of the key 2 upwards to an initial position.

In this instance, the elastic section 23 of the hammer member 3 is formed by a synthetic resin having elasticity, such as urethane resin. As shown in FIG. 1, the elastic section 23 is configured such that the upper end surface slides in an elastic state in the front-rear direction (left-right direction in FIG. 1) on the upper inner surface of the opening 18 of the hammer holding section 17, and the lower end portion slides in an elastic state in the front-rear direction (left-right direction in FIG. 1) on the lower inner surface of the opening 18 of the hammer holding section 17.

Figure 3A:
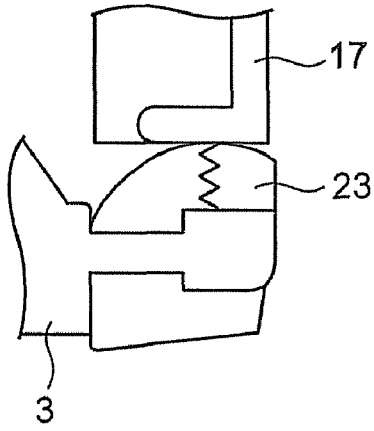
FIG. 3A is an enlarged cross-sectional view of the key sections showing the elastic deformation of an elastic section by a hammer holding section of a key in FIG. 2, in which the elastic section is in an initial state where the key has not been depressed.
Figure 3B:
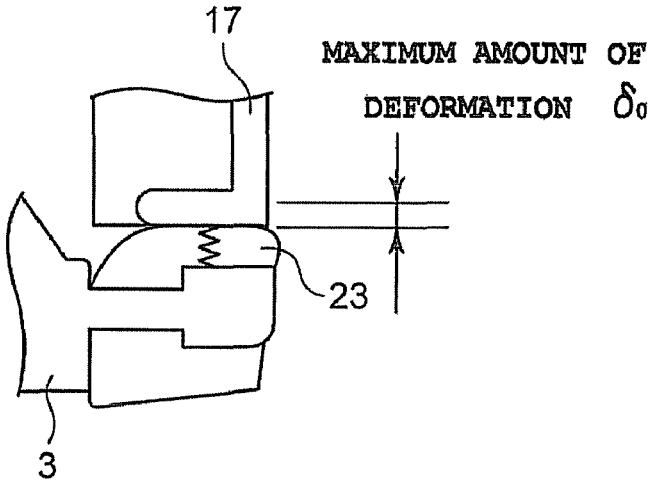
FIG. 3B is also an enlarged cross-sectional view of the key sections showing the elastic deformation of the elastic section by the hammer holding section of the key in FIG. 2, in which the elastic section has been elastically deformed by the key being depressed.

Accordingly, as shown in FIG. 1 and FIG. 2, In the configuration of the hammer member 3, when the key 2 is depressed from above and the elastic section 23 of the hammer body 20 is pressed downward by the hammer holding section 17 of the key 2 against the weight of the gravity center of the hammer body 20 because the gravity center of the hammer body 20 including the weight of the anchor section 21 is at a distance from the supporting shaft 9*a* of the hammer supporting section 9 that is the rotational center of the rotation supporting section 22, as shown in FIG. 3B, the elastic section 23 is elastically deformed. When the elastic deformation reaches its maximum (50), the hammer member 3 starts rotating around the supporting shaft 9*a* serving as the rotation support. As a result, the timing of reaction force that is an action load applied to the key 2 by the hammer member 3 is delayed.

Figure 4:
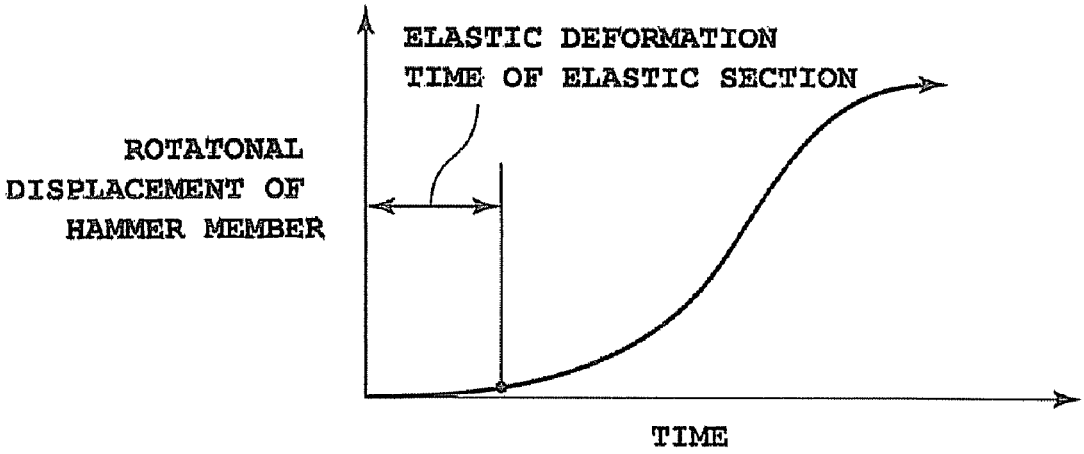
FIG. 4 is a characteristics chart showing the relationship between the amount of displacement and time when the hammer member rotates to be displaced by the key being depressed in FIG. 2.

That is, when the key 2 is depressed and the hammer member 3 rotates, the elastic section 23 is elastically deformed. Accordingly, as shown in FIG. 4, the rotational displacement of the hammer member 3 is small while the elastic section 23 is being elastically deformed, and in connection therewith, reaction force that is an action load applied to the key 2 by the hammer member 2 is also small. However, when the elastic deformation of the elastic section 23 reaches its maximum (δ0) as shown in FIG. 3B, the rotational displacement of the hammer member 3 suddenly increases, and in connection therewith, the reaction force that is the action load applied to the key 2 by the hammer member 3 also suddenly increases.

Figure 5A:
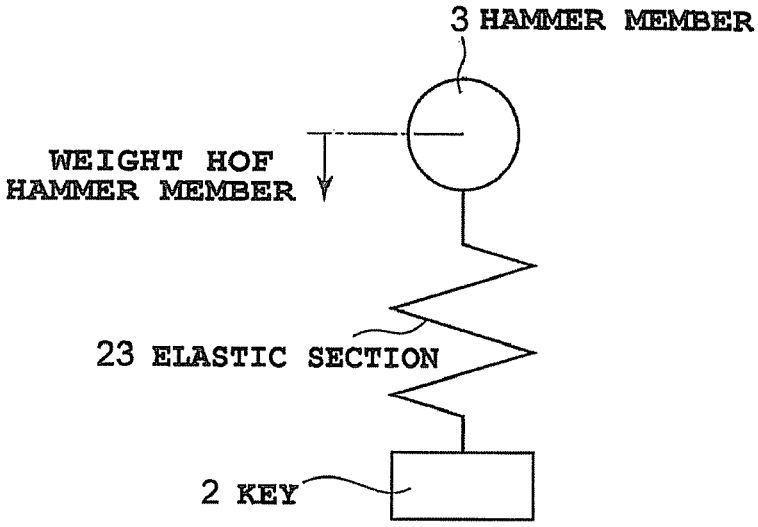
FIG. 5A is a schematic diagram showing a principle under which the elastic section in FIG. 3A is elastically deformed in response to the depression of the key and an initial state in which the key has not been depressed.
Figure 5B:
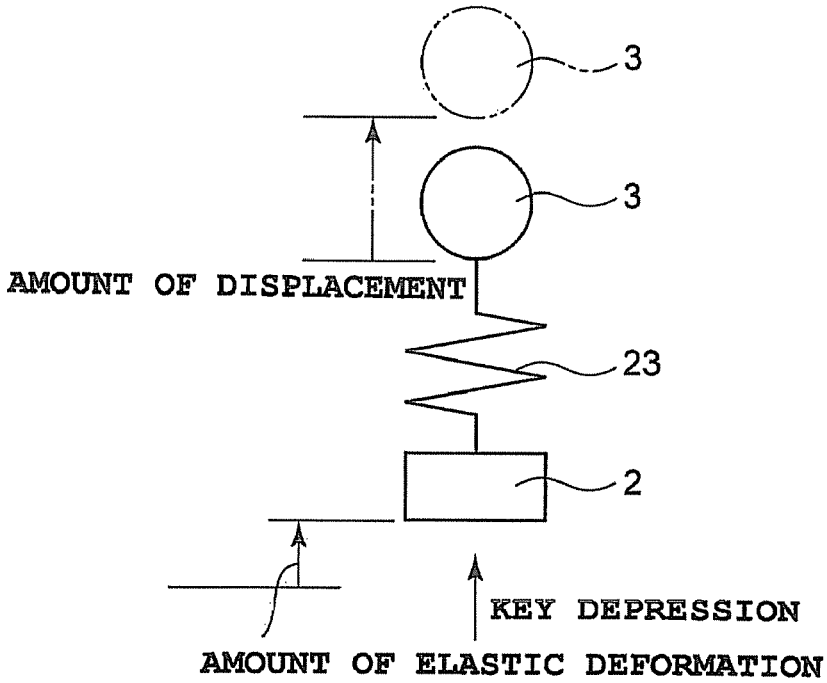
FIG. 5B is a schematic diagram showing the principle under which the elastic section in FIG. 3A is elastically deformed in response to the depression of the key, and a state in which the hammer member is pushed upwards after the elastic section is elastically deformed to its maximum by the key being depressed.

The temporal delay of an action load applied to the key 3 by the hammer member 3 occurs as a result of the elastic deformation of the elastic section 23, and is determined by a correlation between the three components, namely, the key 2, the hammer member 3, and the elastic section 23. Accordingly, with reference to FIG. 5A and FIG. 5B, the correlation the key 3, the hammer member 3, and the elastic section 23 will be described hereafter. FIG. 5A and FIG. 5B are schematic diagrams showing a principle behind the relationship between the key 2, the hammer member 3, and the elastic section 23. To simplify the description, the key 3 and the hammer member 3 are shown in a vertically inverted state.

In the initial state where the key 2 has not been depressed, as shown in FIG. 5A, only the weight (H) of the hammer member 3 is applied to the elastic section 23. When the key 2 is depressed from the lower side to the upper side in this state, as shown in FIG. 5B, the elastic section 23 is compressed by the pressing force from the key 2, and elastically pushes the hammer member 3 upward. This force pushing the hammer member 3 upward is reaction force of the action load applied to the key 2, and is resultant force of the moment of inertia (I) of the hammer member 3 and gravity (weight H) working on the hammer member 3.

That is, the elastic section 23 is compressed and deformed by pressing force from the key 2, the moment of inertia (I) of the hammer member 3, and the weight (H) of the hammer member 3. At this time, the elastic section 23 is elastically deformed in an almost constant oscillation cycle as shown in FIG. 4. The oscillation cycle of reaction force that is an action load from the hammer member 3, which is the beginning portion of the above-described cycle, is based on the elastic deformation of the elastic section 23, and accordingly the oscillation cycle of reaction force from the hammer member 3 can be changed by the oscillation cycle of the elastic section 23 being changed.

Figure 6:
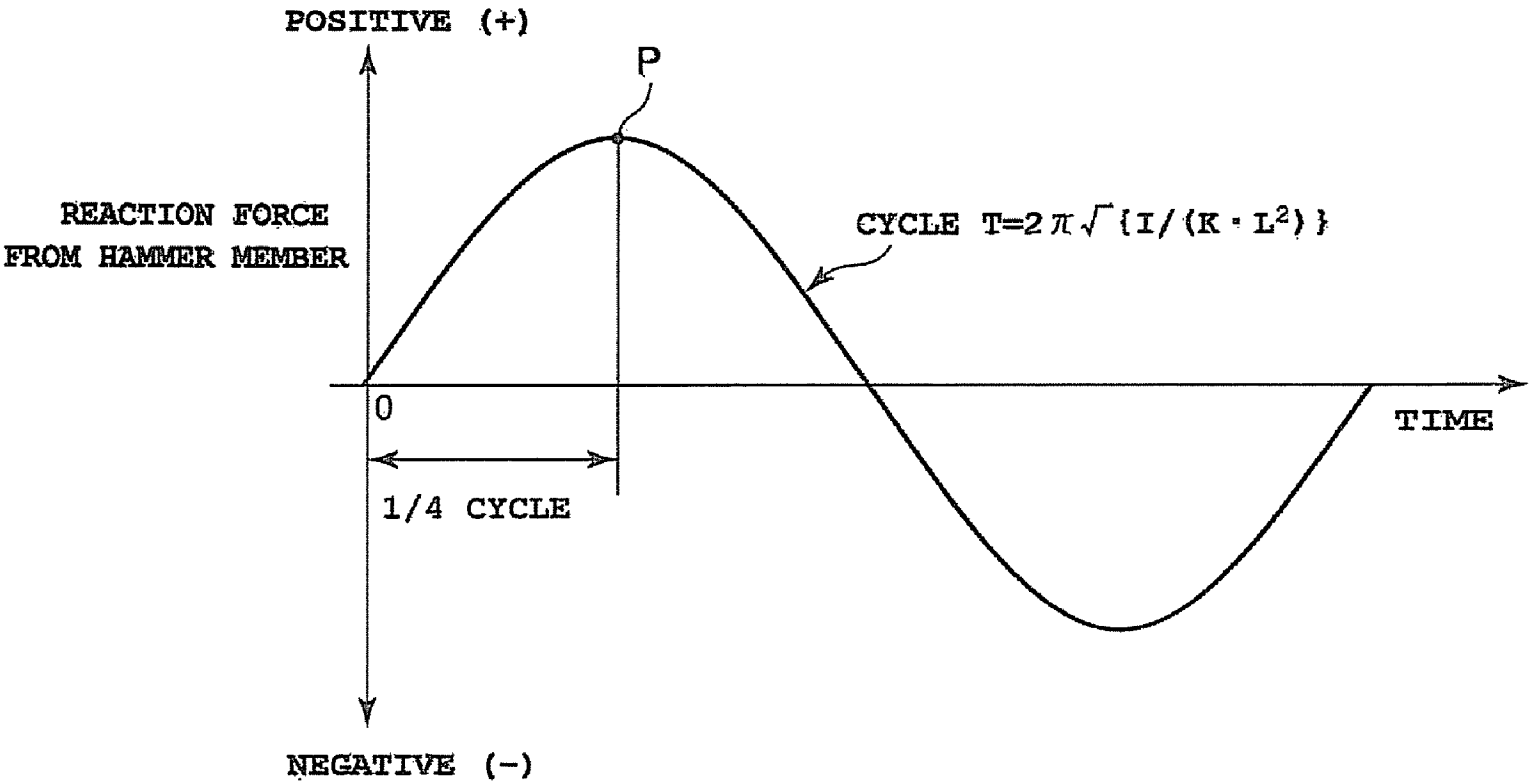
FIG. 6 is a diagram showing a cycle in which the peak of reaction force from the hammer member appears in FIG. 5.

Therefore, as shown in FIG. 6, the appearance timing (time) of the peak (maximum value) of reaction force from the hammer member 3 occurs in an almost constant oscillation cycle, and the peak is required to be set at a point (P) where acceleration reverses from positive (+) to negative (−) in this oscillation cycle. Accordingly, the timing at which the peak of reaction force from the hammer member 3 appears is required to be at ¼ portion in the first half of the oscillation cycle shown in FIG. 6.

Based on the above, the determination of the timing at which the peak of reaction force from the hammer member 3 appears with a delay by a theoretical formula will be described.

To find this theoretical formula, first, in FIG. 2, let a distance in the horizontal direction from the supporting shaft 9*a* serving as the rotation support of the hammer member 3 to the contact point at which the hammer holding section 17 of the key 2 comes into contact with the elastic section 23 of the hammer member 3 be L, a distance from the rotation support of the hammer member 3 to the center of gravity G of the hammer member 3 be R, the moment of inertia around the rotation support of the hammer member 3 be I, and the overall weight of the hammer member 3 be H.

At the instant that the hammer member 3 starts to rotate under this condition, the elastic deformation (amount of elastic deformation δ) of the elastic section 23 is at a maximum (δ0), and the reaction force (S) matches the dead weight (weight H) of the hammer member 3. Therefore, the following equation is established:

$$S=(R/L)*H \quad \text{[Equation 1]}$$

Here, let the elastic modulus of the elastic section 23 in the vertical direction be K. Then, the reaction force (S) at this time is:

$$S=K\cdot\delta 0 \quad \text{[Equation 2]}$$

Because Equation 1 and Equation 2 are equal, the following equation is obtained:

$$S=(R/L)\cdot H=K\cdot\delta 0 \quad \text{[Equation 3]}$$

If the elastic deformation of the elastic section 23 increases by δ and the reaction force (S) increases by K·δ when the key 2 is depressed and displaced downward, the reaction force from the elastic section 23 of the hammer member 3 is:

$$S=(K\cdot\delta 0)+(K\cdot\delta) \quad \text{[Equation 4]}$$

Here, let the angle by which the hammer member 3 rotates when the elastic deformation (δ) of the elastic section 23 increases be θ (radian). Then, in this instance, the elastic deformation (δ) of the elastic section 23 is:

$$\delta=L\cdot\sin\theta \quad \text{[Equation 5]}$$

In this instance, because the rotation angle (θ) of the hammer member 3 is minute, let sin θ=θ. Then, the following equation is established:

$$\delta=L\cdot\theta \quad \text{[Equation 6]}$$

When Equation 3 and Equation 6 are substituted into Equation 4, the following equation is obtained:

$$S=\{(R/L)\cdot H\}+(K\cdot L\cdot\theta) \quad \text{[Equation 7]}$$

On the other hand, when creating an equation of motion of the hammer member 3, if the difference between the moment of force (H·R) on the center of gravity (G) side of the hammer member 3 and the moment of force (S·L) on the elastic section 23 side of the hammer member 3 with the rotation support (supporting shaft 9*a*) of the hammer member 3 at the center is equal to the product (I·θ") of the moment of inertia I and the angular acceleration θ" at the time of the rotation of the hammer member 3 (where, $\theta''=(d^2\theta/dt^2)$), then the following equation is established:

$$I\cdot\theta''=(H\cdot R)-(S\cdot L) \quad \text{[Equation 8]}$$

When Equation 8 is substituted into Equation 7 and reorganized, then the following equation is obtained:

$$(I\quad\theta'')+(K\cdot L^2\cdot\theta)=0 \quad \text{[Equation 9]}$$

Here, the movement cycle (T) of the hammer member 3 is a sine curve as shown in FIG. 6. Therefore, the following equation is established:

$$T=2\pi\cdot\sqrt{\{I/(K\cdot L^2)\}} \quad \text{[Equation 10]}$$

In the movement cycle (T), the partial cycle (Q) until the reaction force of the hammer member 3 reaches its maximum is ¼ of the movement cycle (T). Therefore, the following equation is established:

$$Q=(1/4)\cdot 2\Pi\cdot\sqrt{\{I/(K\cdot L^2)\}} \quad \text{[Equation 11]}$$
$$=(\Pi/2)\cdot\sqrt{\{I/(K\cdot L^2)\}}$$

This ¼-cycle (Q) is the amount of time required for the reaction force (S) of the hammer member 3 to reach its maximum. The moment of inertia (I) around the rotation support that is the rotation supporting section 22 of the hammer member 3, the elastic modulus (K) of the hammer member 3 in the vertical direction, and the distance (L) in the horizontal direction from the rotation support of the hammer member 3 to the contact point at which the elastic section 23 of the hammer member 3 comes into contact with the hammer holding section 17 of the key 2 are required to be set such that the reaction force (S) becomes the maximum reaction force of the key-touch of an acoustic piano in this ¼-period (Q).

That is, regarding the timing at which the reaction force of the key-touch of an acoustic piano reaches its maximum, the difference between the peak time of the reaction force of a soft keystroke (T1 in FIG. 7) and the peak time of the reaction force of a hard keystroke (T2 in FIG. 8) is minimal, roughly 10 milliseconds (msec) to 20 msec. Therefore, the ¼-cycle (Q) is preferably set to 10 msec or more and 20 msec or less.

To express the above using the moment of inertia (I) of the hammer member 3 and the distance (L) in the horizontal direction, when ($I/L^2$) in Equation 11 is substituted with A and the equation is reorganized, the ¼-cycle (Q) is:

$$Q=(\pi/2)\cdot\sqrt{\{I/(K\cdot L^2)\}}=(\pi/2)\cdot\sqrt{(A/K)} \quad \text{[Equation 12]}$$

When A is determined by both sides of Equation 12 being squared, the following equation is obtained:

$$A=Q^2\cdot(2/\pi)^2\cdot K \quad \text{[Equation 13]}$$

In Equation 13, when the ¼-cycle (Q) is 10 msec, A is:

$$A=(I/L^2)=(2/\pi)^2\cdot K\cdot 10^{-4} \quad \text{[Equation 14]}$$

Also, when the ¼-period (Q) is 20 msec, A is:

$$A=(I/L^2)=4\cdot(2/\pi)^2\cdot K\cdot 10^{-4} \quad \text{[Equation 15]}$$

When an equation for setting the partial cycle (Q) to 10 msec or more and 20 msec or less using Equation 14 and Equation 15 is determined, the following equation is obtained:

$$(2/\pi)^2\cdot K\cdot 10^{-4}\leqq(I/L^2)\leqq 4\cdot(2/\pi)^2\cdot K\cdot 10^{-4} \quad \text{[Equation 16]}$$

Next, the workings of the keyboard device will be described.

In the keyboard device, when the key 2 is depressed, the key 2 rotates in the clockwise direction in FIG. 2 around the supporting shaft 14*a* of the key supporting section 14 of the keyboard chassis 1, and the hammer supporting section 17 of the key 2 presses the elastic section 23 of the hammer member 3 downward. Then, after the elastic section 23 is elastically deformed, the hammer member 3 rotates in the clockwise direction in FIG. 2 around the supporting shaft 9*a* serving as the rotation support in the hammer supporting section 9 of the keyboard chassis 1, and applies an action load to the key 2 with a predetermined time delay.

That is, when the key 2 is depressed and the hammer member 3 rotates, the elastic section 23 is elastically deformed. Therefore, as shown in FIG. 4, the rotational displacement of the hammer member 3 is small while the elastic section 23 is being elastically deformed, and in connection therewith, reaction force that is an action force applied to the key 2 by the hammer member 3 is also small.

Subsequently, when the elastic deformation of the elastic section 23 reaches its maximum (δ0), the rotational displacement of the hammer member 3 suddenly increases, and in connection therewith, the reaction force that is the action load applied to the key 2 by the hammer member 3 also suddenly increases. As a result, the timing at which the action load applied to the key 2 by the hammer member 3 reaches its maximum (peak) is delayed.

This delay in the timing at which the reaction force that is the action load applied to the key 2 by the hammer member 3 reaches its maximum occurs because of the elastic deformation of the elastic section 23, and the delay time can be set between 10 msec and 20 msec by the distance (L) in the horizontal direction from the rotation support of the hammer member 3 to the contact point at which the elastic section 23 comes into contact with the hammer member 3, the moment of inertia (I) around the rotation support of the hammer member 3, and the elastic modulus (K) in the vertical direction of the elastic section 23 of the hammer member 3 coming into contact with the key 2 being set based on the above-described Equation 16.

Figure 7:
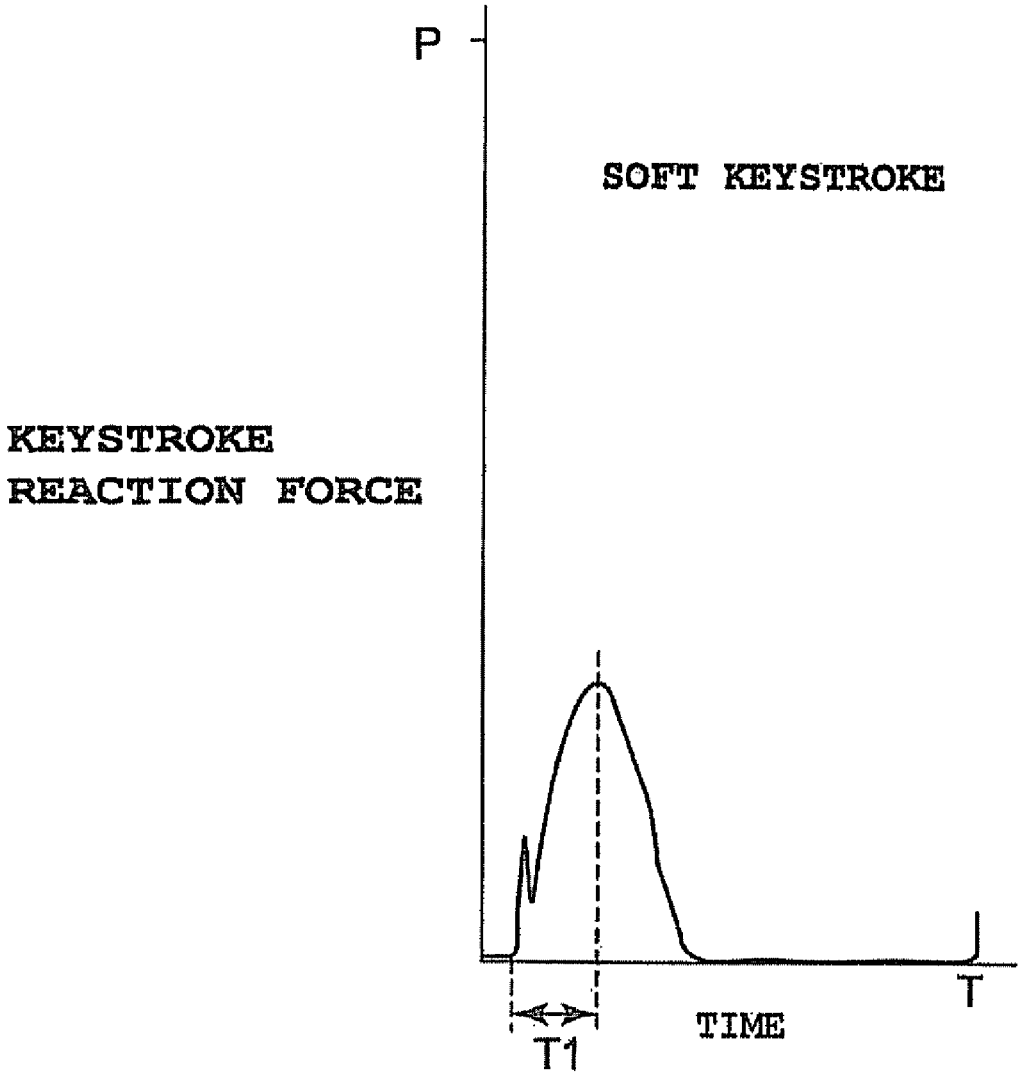
FIG. 7 is a characteristics chart of a relationship between reaction force and time when the key in the keyboard device is depressed with a weak force.
Figure 8:
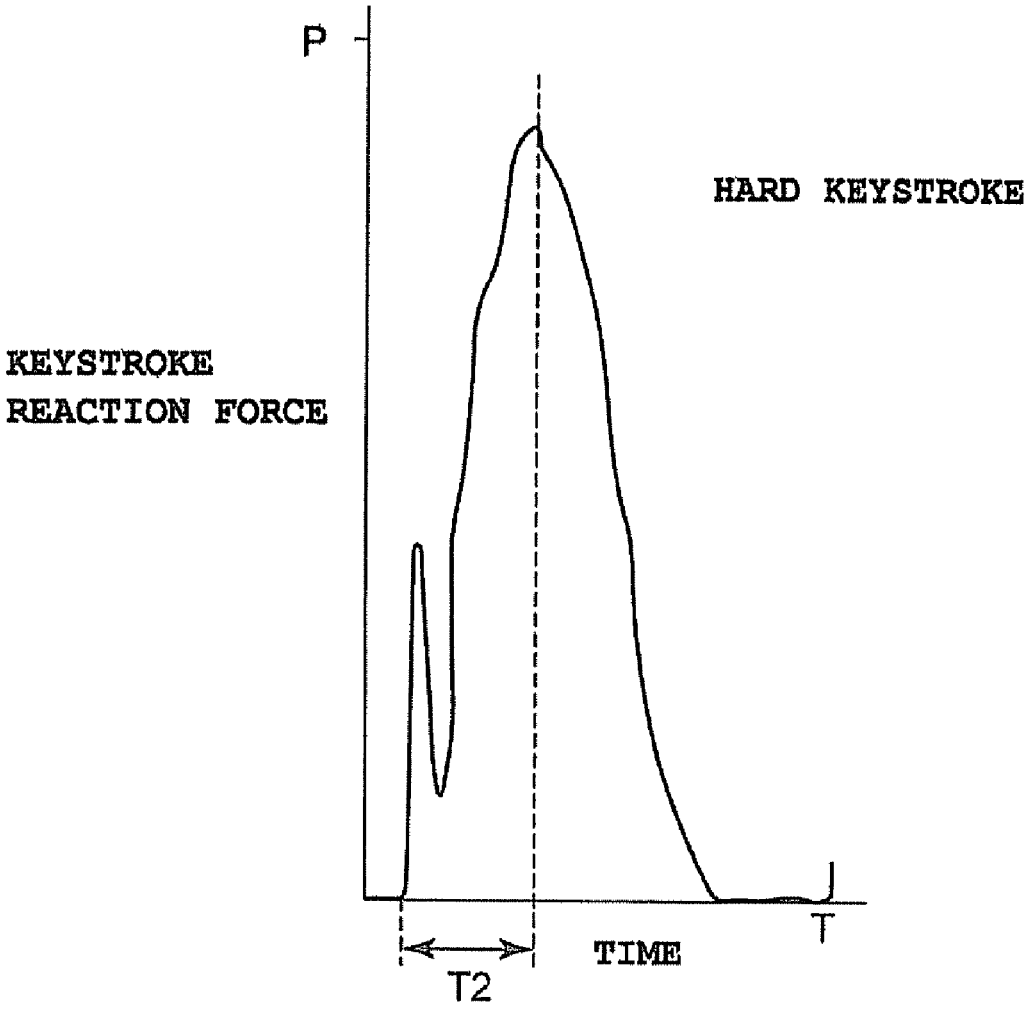
FIG. 8 is a characteristics chart of a relationship between reaction force and time when the key in the keyboard device is depressed with a strong force.

Therefore, in the keyboard device, as shown in FIG. 7 and FIG. 8, when the key 2 is depressed, the timing at which the action load applied to the key 2 by the hammer member 3 reaches its peak can be delayed by an amount of time between 10 msec to 20 msec from the start of the depression of the key 2. Accordingly, the maximum action load can be applied at a timing that gives a key-touch feel close to that of an acoustic piano. As a result, a key-touch feel more similar to that of an acoustic piano can be obtained.

As described, in the keyboard device, when L represents the distance in the horizontal direction from the rotation support of the hammer member 3 to the contact point at which the elastic section 23 comes into contact with the hammer member 3, I represents the moment of inertia around the rotation support of the hammer member 3, and K represents the elastic modulus in the vertical direction of the elastic section 23 of the hammer member 3 coming into contact with the key 2, in the initial state where the key 2 has not been depressed, then the relationship between the distance (L) in the horizontal direction, the moment of inertia (I), and the elastic modulus (K) is set to $$(2/\pi)^2 \cdot K \cdot 10^{-4} \leqq (I/L^2) \leqq 4 \cdot (2/\pi)^2 \cdot K \cdot 10^{-4}.$$

As a result, the distance (L) in the horizontal direction, the moment of inertia (I), and the elastic modulus (K) can be set so as to establish an optimal relationship.

Accordingly, the timing at which an action load applied to the key 2 by the hammer member 3 when the key 2 is depressed reaches its maximum can be delayed by a predetermined amount of time. As a result, when the key 2 is depressed, the maximum action load can be applied at a timing that gives a key-touch feel close to that of an acoustic piano, whereby a key-touch feel similar to that of an acoustic piano can be obtained.

In this instance, the time delay of the timing at which an action load applied to the key 2 by the hammer member 3 reaches its peak is set between 10 msec to 20 msec from the start of the depression of the key 2. Accordingly, when the key 2 is depressed, the timing at which an action load applied to the key 2 by the hammer member 3 reaches its peak can be infallibly delayed by an amount of time between 10 msec to 20 msec. As a result, the maximum action load can be applied at a timing that gives a key-touch feel close to that of an acoustic piano, whereby a key-touch feel more similar to that of an acoustic piano can be obtained.

In the configuration of the above-described embodiment, the elastic section 23 is provided in the tip end portion of the hammer member 3, the elastic section 23 is slidably held in an elastic state on the lower inner surface inside the opening 18 of the hammer holding section 17 of the key 2, and the elastic section 23 is elastically deformed when the key 2 is depressed. However, the present invention is not limited thereto. For example, an elastic section may be provided in the hammer holding section 17 of the key 2. Alternatively, the hammer holding section 17 itself may be elastically deformed in the vertical direction. In this instance as well, the elastic modulus (K) of the elastic section of the hammer holding section 17 or the elastic modulus (K) by which the hammer holding section 17 itself elastically deforms in the vertical direction is required to be set so as to adapt to Equation 16 in the above-described embodiment.

According to the above-described embodiment, the elastic section 23 is provided in the tip end portion of the hammer member 3. However, the present invention is not limited thereto. For example, a portion of the hammer body 20 excluding the tip end portion of the hammer member 3 may be formed as an elastic section. Alternatively, the overall hammer body 20 of the hammer member 3 may be formed as an elastic section that flexes and becomes deformed. In this instance, a portion excluding the tip end portion of the hammer member 3 refers to, for example, the hammer holding section 17 of the hammer body 20. This hammer holding section 17 may be formed as the elastic section using an elastic material, and configured to become elastically deformed when an action load is applied to the key 2 in response to a key-depressing operation.

In addition, the overall hammer body 20 of the hammer member 3 may be formed as an elastic section that flexes and becomes deformed using an elastic material, and configured to flex and become elastically deformed when an action load is applied to the key 2 in response to a key-depressing operation. In this instance as well, the elastic modulus (K) of the hammer holding section 17 provided in a portion excluding the tip end portion of the hammer member 3 or the elastic modulus (K) by which the overall hammer body 20 flexes and becomes deformed is required to be set so as to adapt to Equation 16 in the above-described embodiment.

Even in the configurations described above, as in the case of the above-described embodiment, when the key 2 is depressed, the timing at which an action load applied to the key 2 by the hammer member 3 reaches its peak can be infallibly delayed by an amount of time between 10 msec to 20 msec. Therefore, the maximum action load can be applied at a timing that gives a key-touch feel close to that of an acoustic piano, whereby a key-touch feel more similar to that of an acoustic piano can be obtained.

Moreover, the present invention is not limited to the above-described configurations. For example, an elastic section having an elastic modulus of K1 may be provided in either the hammer member 3 or the key 2 in a contact area between the hammer member 3 and the key 2, and a portion of the hammer body 20 of the hammer member 3 or the overall hammer body 20 may be formed as an elastic section that becomes elastically deformed. In this instance, the elastic modulus (K1) of the elastic section in either the hammer member 3 or the key 2 in the contact area between the hammer member 3 and the key 2, and the elastic modulus (K2) of a portion of the hammer body 20 or the overall hammer body 20 is required to be set so as to establish a relationship where a combined elastic modulus (K) of the elastic modulus (K1) and the elastic modulus (K2) is:

$$K = K1 \cdot K2 / (K1 + K2)$$

Even in the configurations described above, as in the case of the above-described embodiment, when the key 2 is depressed, the timing at which an action load applied to the key 2 by the hammer member 3 reaches its peak can be infallibly delayed by an amount of time between 10 msec to 20 msec. Therefore, the maximum action load can be applied at a timing that gives a key-touch feel close to that of an acoustic piano, whereby a key-touch feel more similar to that of an acoustic piano can be obtained.

In the above-described embodiment and in each variation example thereof, when θ (radian) represents the angle by which the hammer member 3 rotates at the time the elastic deformation (5) of the elastic section 23 increases, the elastic deformation (5) of the elastic section 23 is:

$$\delta = L \cdot \sin\theta \qquad \text{[Equation 5]}$$

Here, because the rotation angle (θ) of the hammer member 3 is minute, when sin θ=θ, the following equation is established:

$$\delta = L \cdot \theta \quad \text{[Equation 6]}$$

However, this calculation is not necessarily required to be performed with sin θ=θ, and may be performed by $$\delta = L \cdot \sin\theta \quad \text{[Equation 5]}$$

Furthermore, in the above-described embodiment, the rotation supporting section 22 of the hammer member 3 is rotatably attached to the supporting shaft 9*a* of the hammer supporting section 9 of the keyboard chassis 1. However, the present invention is not limited thereto. For example, the hammer supporting section 9 may be independently provided on the lower-portion case 5 of the instrument body, and the rotation supporting section 22 of the hammer member 3 may be rotatably attached to the supporting shaft 9*a* of the hammer supporting section 9. Even by a configuration such as this, effects similar to those achieved by the above-described embodiment can be achieved.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a keyboard chassis;

a key provided on the keyboard chassis in a manner to be rotatable in a vertical direction;

a hammer member for applying an action load to the key by rotating to be displaced in response to depression of the key; and an elastic section provided in at least one of either the hammer member or the key, which is elastically deformed in response to the depression of the key;

wherein the keyboard device is configured such that, when considered as a mechanical oscillation system model where L represents a distance in a horizontal direction from a rotation support of the hammer member to a contact point at which the key comes into contact with the hammer member, I represents a moment of inertia around the rotation support of the hammer member, and K represents an elastic modulus in a vertical direction of the elastic section in at least one of either the hammer member or the key, in an initial state in which the key has not been depressed, a relationship of the distance L in the horizontal direction, the moment of inertia I, and the elastic modulus K is set to $(2/\pi)^2 \cdot K \cdot 10^{-4} \leqq (I/L^2) \leqq 4 \cdot (2/\pi)^2 \cdot K \cdot 10^{-4}$, and a timing at which the action load applied to the key by the hammer member in response to the depression of the key reaches a maximum is delayed by a predetermined amount of time.

2. The keyboard device according to claim 1, wherein a delay time of the timing at which the action load applied to the key by the hammer member reaches the maximum is set between 10 milliseconds to 20 milliseconds from the start of depression of the key.

3. The keyboard device according to claim 1, wherein the elastic section which is elastically deformed with the elastic modulus K is provided in at least one of either the hammer member or the key in a contact area between the hammer member and the key.

4. The keyboard device according to claim 1, wherein the elastic section which is elastically deformed with the elastic modulus K is provided in a portion of the hammer member or in the overall hammer member, and flexes and deforms the hammer member when the action load is applied to the key.

5. The keyboard device according to claim 1, wherein the keyboard device is configured such that, a first elastic section having an elastic modulus of K1 is provided in at least one of either the hammer member or the key in a contact area between the hammer member and the key, and a second elastic section that flexes and becomes deformed with an elastic modulus of K2 is provided in a portion of the hammer member or in the overall hammer member, in which case the elastic modulus K in the vertical direction of both the first elastic section and the second elastic section is set to a relationship $K = K1 \cdot K2/(K1+K2)$.

6. The keyboard device according to claim 1, wherein the distance L, the moment of inertia I, and the elastic modulus K are predetermined such that the timing at which the action load reaches the maximum ranges in one-fourth of a oscillation cycle of the mechanical oscillation system model.

* * * * *